US005383979A

United States Patent [19]

Schneider

[11] Patent Number: 5,383,979

[45] Date of Patent: Jan. 24, 1995

[54] PROCESS FOR PRODUCING A SURFACE-HARDENED WORKPIECE FROM SINTERED IRON

[75] Inventor: Rudolf Schneider, Froendenberg, Germany

[73] Assignee: Robert Bosch GmbH, Stuttgart, Germany

[21] Appl. No.: 94,187

[22] Filed: Aug. 2, 1993

[30] Foreign Application Priority Data

Dec. 5, 1991 [DE] Germany ..... 4140148
Feb. 7, 1992 [DE] Germany ..... 4103692

[51] Int. Cl.[6] ..... C23C 8/18

[52] U.S. Cl. ..... 148/217; 148/225; 148/226; 148/230

[58] Field of Search ..... 148/217, 225, 226, 230

[56] References Cited

U.S. PATENT DOCUMENTS 4,738,730 4/1988 Ferguson ..... 148/230
4,799,970 1/1989 Koiso et al. ..... 148/267

FOREIGN PATENT DOCUMENTS

3224420A1 3/1983 Germany .
3301541A1 7/1984 Germany .
3806933A1 11/1989 Germany .

*Primary Examiner*—Richard O. Dean
*Assistant Examiner*—Robert R. Koehler
*Attorney, Agent, or Firm*—Spencer, Frank & Schneider

[57] ABSTRACT

In a process for producing a workpiece from sintered metal, especially from sintered iron, the latter is subjected, after sintering, to a steam treatment at temperatures below 500° C., especially at 430°-480° C., at a steam partial pressure of from 20 to 80 mbar, especially from 30 to 50 mbar, to form an oxide layer on the surface, and to subsequent surface-hardening. Workpieces, especially internally geared wheels for starters, having a wear-resistant surface and, in the core, properties unchanged by the hardening are obtained.

11 Claims, No Drawings

PROCESS FOR PRODUCING A SURFACE-HARDENED WORKPIECE FROM SINTERED IRON

BACKGROUND OF THE INVENTION

The invention relates to a process for producing a surface-hardened workpiece from sintered iron, the pores on the surface being largely closed after sintering by means of a steam treatment and the workpiece then being subjected to surface-hardening.

German Offenlegungsschrift 3,301,541 discloses a process of the above type. For the purpose of closing the pores as a pretreatment for surface-hardening, a steam treatment is carried out here. To improve the dimensional stability, German Offenlegungsschrift 3,301,541 proposes heating the porous workpiece of sintered iron in a steam-containing atmosphere to produce iron oxide layers on the accessible inner and outer surfaces and, in a second stage, to partially reduce these oxide layers and to harden a narrow zone, starting from the outer surface, in the presence of a carbon-releasing fluid. However, the control of this process and hence also the control of the formation or reduction of the oxide layer are very restricted.

The workpieces produced from a sintered iron, that is to say by powder metallurgy, are in general, porous, unless they are compacted by forging or other forming processes. However, porosity has disadvantages, for example with respect to the corrosion resistance which is impaired, since, for example, liquid materials penetrate into the porous workpiece. This then causes reactions with corrosive agents or the like, the property of the workpiece surface being changed. To prevent penetration of such materials into the surface of a porous workpiece, it is known to coat the latter with synthetic resin, wax, an oily substance or the like.

The porosity of sintered workpieces is additionally disadvantageous if it is intended to obtain surface-hardening. The gases used for hardening can penetrate through the pores into the interior of the workpiece, which hardens throughout. To achieve exclusively surface-hardening, a substantial pore closure, which is stable during the hardening process, is therefore necessary. However, the coatings described above are unstable, so that a corresponding impregnation cannot be used for sintered workpieces which have been subjected to heat treatment after sintering.

Heat treatment is carried out above all for obtaining a greater hardness. Known heat treatment processes are carburising, nitrocarburising, nitriding and oxidising. Surfaces of high wear resistance can be obtained by these processes.

SUMMARY OF THE INVENTION

In accordance with the present invention, there is provided a process for producing a workpiece from sintered iron, the pores on the surface of the workpiece first being largely closed after sintering by means of a treatment with superheated steam and the workpiece then being subjected to surface-hardening, the process further comprising the step of carrying out the steam treatment at a temperature between 430° and 500° c., at a steam partial pressure of from 20 to 80 mbar, and for at most 2 hours, thereby to from an oxide layer having a maximum thickness of 5 μm. Most preferably, the temperature of the steam will be 430°–480° C. and the steam partial pressure will be from 30 to 50 mbar.

Thus according to the present invention, the steam treatment is carried out so that sufficient pore closure achieved with the lowest possible thickness of the oxide layer. Surprisingly, these properties can be obtained even at relatively low steam temperatures, which results in an economical procedure with consistently good results.

A further advantage of the lower steam temperatures results from the fact that the formation FeO is avoided, which starts at about 560° C. On cooling, FeO decomposes into $Fe_3O_4$ and Fe. This decomposition leads to a spongy surface structure which, in addition to a markedly reduced corrosion resistance, also leads to a voluminous connecting layer during the subsequent heat treatment, and thus especially to a deterioration in the dimensional stability.

Preferably, an oxide layer of at most 5 μm, preferably of <4 μm, is produced on the surface of the workpiece by the modified steam treatment. This is effected by a controlled steam treatment at the indicated temperatures and pressures of the superheated steam. The objective is an adequate pore closure, with minimum thickness of the oxide layer.

DESCRIPTION OF THE PREFERRED EMBODIMENT

According to an illustrative example, the workpiece is subjected to mechanical working before the steam treatment. The mechanical working is here preferably carried out by vibratory grinding or by lap-blasting.

The mechanical working is advisable above all if narrow tolerances in the dimensional stability are prescribed or if a well-formed layer with narrow tolerances is demanded. After the mechanical working, the workpiece is subjected to surface-hardening.

The abovementioned process is used above all in the manufacture of hollow wheels, in which case a markedly improved dimensional stability was found. Waste can be considerably reduced by the process, and measurement is no longer necessary.

In an illustrative example, a hollow wheel hardened by nitrocarburising is manufactured in the following fabrication stages:

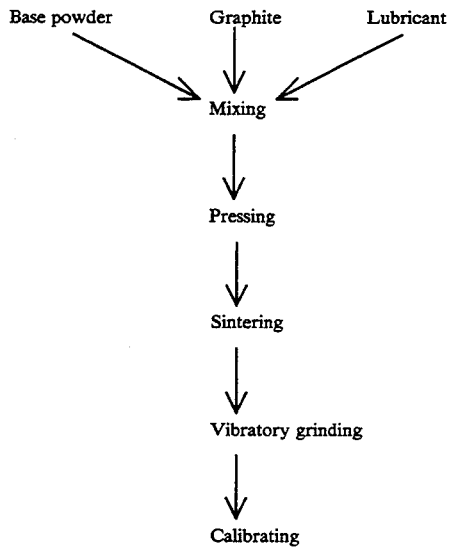

-continued

↓

Steam treatment
at 430–480° C.,
30–50 mbar and 2 hours

↓

Nitrocarburising

As a general proposition, the steam treatment according to the invention should be carried out at a temperature below 560° C., and preferably below 500° C., and most preferably between 430° and 480° C., in order to prevent the formation of FeO and the subsequent decomposition upon cooling into $Fe_3O_4$ and FeO, with the attendant disadvantages as previously discussed.

Further, it should be obvious to the ordinarily skilled person in the art that the surface hardening process of the invention is applicable as well to other types of workpieces that require wear-resistant surfaces while at the same time requiring a core unchanged by the hardening process, for example, layshaft gears for starters, internally geared wheels, and base plates and support plates for electric fuel pumps.

I claim:

1. A process for producing a workpiece from sintered iron, the pores on the surface of the workpiece first being largely closed after sintering by means of a treatment with superheated steam and the workpiece then being subjected to surface-hardening, said process comprising the step of carrying out the steam treatment at a temperature below 430° and 500° C., at a steam partial pressure of from 20 to 80 mbar, and for at most 2 hours, thereby to form an oxide layer having a maximum thickness of 5 μm.

2. A process according to claim 1, comprising the further step of mechanically working the workpiece prior to the steam treatment step.

3. A process according to claim 2 wherein the mechanical working is effected by grinding.

4. A process according to claim 2 wherein the mechanical working is effected by lapping.

5. A process according to claim 1 wherein the steam treatment is carried at a temperature of 430° to 480° C.

6. A process according to claim 1 wherein the steam treatment is carried at a partial pressure of from 30 to 50 mbar,

7. A process according to claim 1 wherein said oxide layer has a thickness of less than 4 μm,

8. A process according to claim 1 wherein the workpiece is a layshaft gear for starters,

9. A process according to claim 8 wherein the gear is an internally geared wheel.

10. A process according to claim 1 wherein the workpiece is a base plate for an electric fuel pump,

11. A process according to claim 1 wherein the workpiece is a support plate for an electric fuel pump.

* * * * *